US006357092B1

(12) United States Patent
Burrows

(10) Patent No.: US 6,357,092 B1
(45) Date of Patent: Mar. 19, 2002

(54) DOUBLE ACTING ADJUSTABLE BUCKLE

(75) Inventor: Ward C. Burrows, Pasadena, CA (US)

(73) Assignee: Ancra International, LLC., Hawthorne, CA (US)

( * ) Notice: Subject to any disclaimer, the term of this patent is extended or adjusted under 35 U.S.C. 154(b) by 0 days.

(21) Appl. No.: 09/494,784

(22) Filed: Jan. 31, 2000

(51) Int. Cl.[7] ..... A44B 11/25

(52) U.S. Cl. ..... 24/644; 24/633; 24/643; 24/265 WS

(58) Field of Search ..... 24/644, 643, 633, 24/265 WS, 163 K

(56) References Cited

U.S. PATENT DOCUMENTS

| | | | | | |
|---|---|---|---|---|---|
| 1,701,112 | A | * | 2/1929 | Johnson | 24/643 |
| 2,807,066 | A | * | 9/1957 | Honey et al. | 24/644 |
| 3,686,720 | A | | 8/1972 | Wehner | |
| 3,728,764 | A | | 4/1973 | Carter | |
| 4,375,713 | A | * | 3/1983 | Bert et al. | 24/265 WS |
| 4,382,318 | A | * | 5/1983 | Takimoto | 24/265 WS |
| 4,414,713 | A | | 11/1983 | Prete, Jr. | |
| 4,539,736 | A | * | 9/1985 | Yokosuka | 24/644 |
| 5,288,105 | A | | 2/1994 | Ikegaya | |

* cited by examiner

*Primary Examiner*—Victor N. Sakran
(74) *Attorney, Agent, or Firm*—Edward A. Sokolski

(57) ABSTRACT

A buckle which is used to removably fasten two pieces of webbing, strap or the like together requires two distinct actions for its opening and thus is "double locking." A latch member is pivotally supported on a frame by means of a support shaft. A first strap end is fixedly attached to one end of the frame. A second strap end to be attached to the first strap end is removably attached to one end of an adjuster member. The other end of the adjuster member is T-shaped. The frame has a pair of opposing ledge portions which extend opposite the base portion of the frame, opposing slots being formed between these portions. The top of the "T" of the adjuster member fits into the slots to retain the adjuster member to the frame when tension is placed on the second strap end portion thereby providing a first locking action. The latch member has a detent formed thereon which engages a detent on the end of the ledge portion of the frame. The latch member further has side walls with slots formed therein which engage the ends of the top of the "T" of the adjuster member. The adjuster member is thus held to the frame when there is no tension on the straps, to provide the second locking action.

9 Claims, 4 Drawing Sheets

DOUBLE ACTING ADJUSTABLE BUCKLE

BACKGROUND OF THE INVENTION

1. Field of the Invention

This invention relates to buckles for removably attaching strap or webbing ends together and more particularly to such a buckle that operates with two distinct locking and release actions.

2. Description of the Related Art

Double locking safety buckles such as described in U.S. Pat. No. 3,728,764 issued Apr. 24, 1973 to Carter have been in use for some time. What is meant by "double locking" is that two distinct and separate actions are required by the user to both lock and release the buckle. In certain jurisdictions, such double action on safety buckles used in harnesses employed in hazardous situations are required by legal regulations. Typical applications for such a safety buckle are parachute harnesses, harnesses for persons working at heights or other dangerous environments. This type of buckle could also be used in tying down cargo during transportation or in attaching together two sections of a web or strap used for lifting cargo or personnel.

For a double acting safety buckle to perform its function properly, two separate and distinct actions in locking and releasing the buckle should be provided. Both actions should be such that a likelihood of accidental unlocking is minimized. Along these lines, many of the prior art devices utilize button releases for one of the actions. This type of release has the disadvantage of being readily subject to accidental actuation. While it is necessary to minimize the possibilities of accidental release, the buckle at the same time should be releasable by the user without undue difficulty.

Also, many of the prior art double acting locking buckles are overly complicated in their construction which makes for greater cost, less reliability, and shorter service life.

SUMMARY OF THE INVENTION

The device of the present invention is an improvement over the prior art in that it provides a double locking buckle which has two separate and distinct locking actions, neither of which is prone to accidental actuation. Further, the device of the present invention incorporates means for easily tightening the web or strap. In addition, the device of the present invention is of simple constructions utilizing a minimum number of parts and is of economical and reliable construction.

In the device of the invention, there are only three basic parts, a frame, a latch member, and an adjuster member. The latch member is pivotally supported on the frame by means of a support shaft which is attached to the frame. A first strap end portion is fixedly attached to one end of the frame. A second strap end portion to be attached to the first strap end portion is removably attached to one end of the adjuster member by suitable means such as reeving through slots formed on the adjuster member so that the effective length of the strap can be readily adjusted in tightening and loosening the strap. The opposite end of the adjuster member has a T-shaped configuration.

The frame has a pair of opposing ledge portions which extend opposite the base portion of the frame, opposing slots being formed in the ledge portions. The top of the "T" of the adjuster member fits into the slots formed in the frame to retain the adjuster member to the frame when tension is placed on the second strap end portion, thereby providing a first locking action. The latch member has a pair of opposing side portions which have slots formed therein. The latch member further has detents formed thereon which engage detents formed on the bottom ends of the ledge portions of the frame and snap thereunder to hold the latch member in position against the end of the adjuster member. The ends of the "T" of the adjuster member fit into the latch member slots, thereby reinforcing the retention of the adjuster member to the frame. The adjuster member is thus retained to the frame even without tension on the straps, thereby providing the second locking action.

In a second embodiment of the invention, the adjuster member has longitudinal slots formed near one end thereof into which the portions of the side portion of the frame adjacent to the slots fit to provide the first locking action; the side portions of the frame member also fitting into these slots to provide the second locking action.

It is therefore an object of this invention to provide an improved double locking adjustable buckle which is of more reliable and economical construction.

It is a further object of this invention to provide a double locking adjustable buckle which provides two distinct locking actions neither of which is susceptible to accidental unlocking.

Other objects of the invention will become apparent in view of the following description taken in connection with the accompanying drawings.

DETAILED DESCRIPTION OF THE INVENTION

Figure 1:
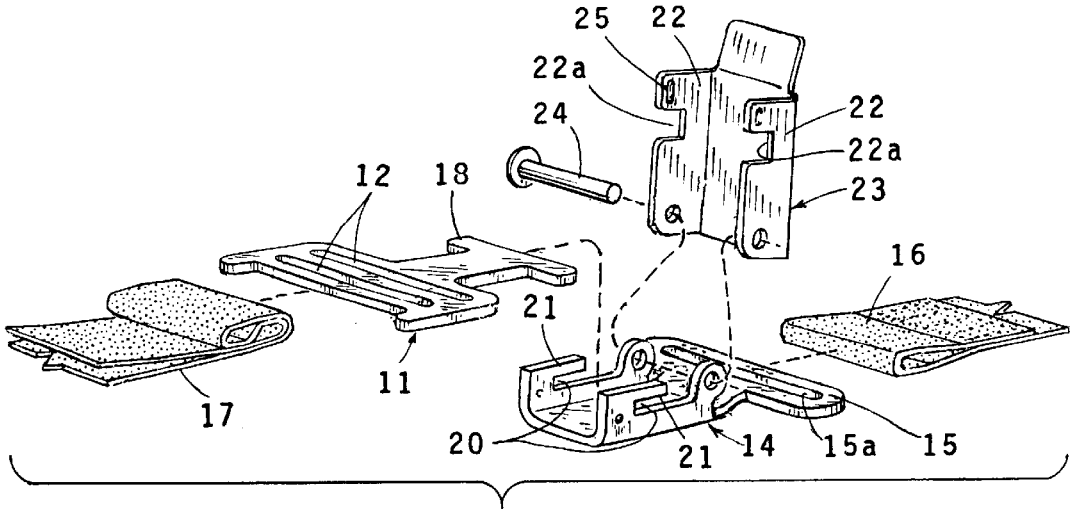
FIG. 1 is an exploded view showing a first embodiment of the device of the invention.
Figure 2:
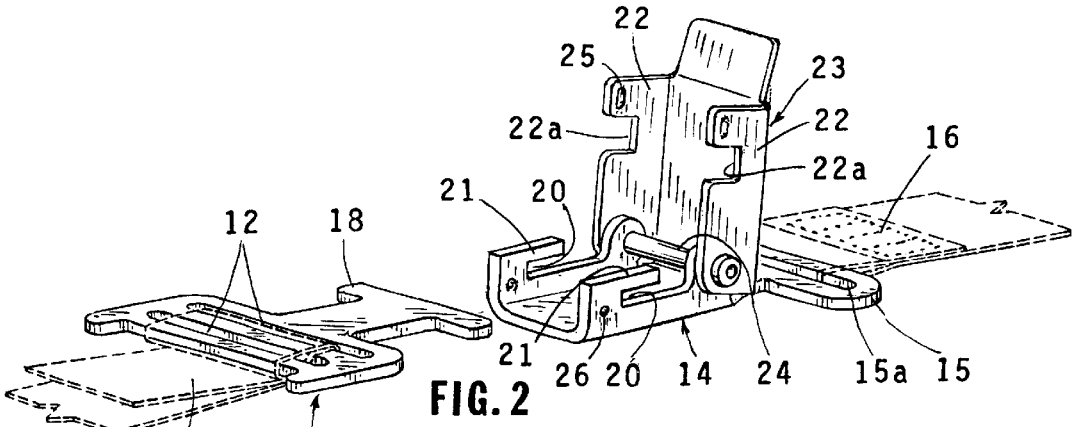
FIG. 2 is a side perspective view of the first embodiment showing the adjuster member immediately before it is installed in the frame.
Figure 3:
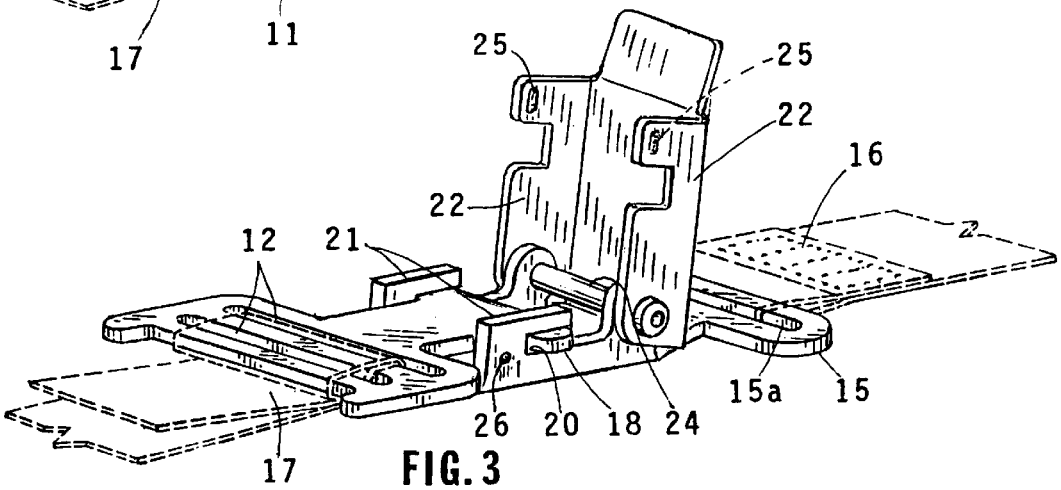
FIG. 3 is a side perspective view of the first embodiment showing the adjuster member installed in the frame with the latch member in the raised position.

Referring now to FIGS. 1–6, a first embodiment of the invention is shown. Frame 14 has a T-shaped end piece 15 which has a slot 15*a* formed therein. The end of web or strap 16 is run through slot 15*a* and stitched together so that it is permanently attached to the end of the frame. Adjuster member 11 has a pair of transverse slots 12 through which the other strap end portion 17 is reeved in a manner such that the strap can be tightened or loosened. Strap end portions 16 and 17 may be the opposite ends of the same strap or may be the ends of two different straps to be connected together. Adjuster member 11 has a T-shaped end 18 which fits into opposing slots 20 formed between ledge portions 21 of the frame and the base portion of the frame, as shown in FIG. 3. With tension applied between the two strap end portions, T-shaped end will be z retained tightly in slot 20 providing a first locking action. Latch member 23 is pivotally supported on frame 14 by means of shaft 24 which is fixedly supported on the frame. The latch member has opposing side portions 22 which have slots 22a formed therein.

Figure 4:
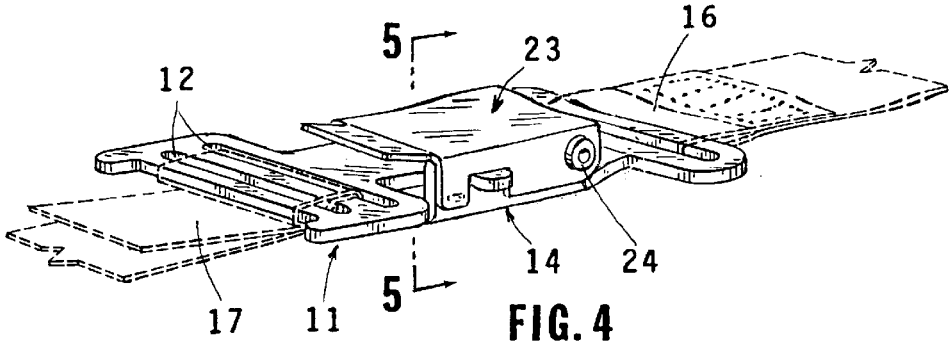
FIG 4 is a side perspective view of the first embodiment showing the latching member in its locked position.
Figure 5:
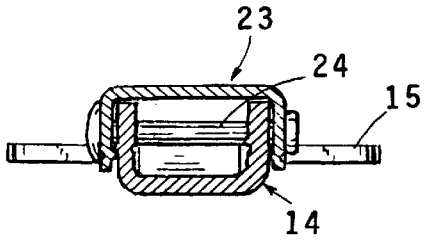
FIG. 5 is a cross sectional view taken along the plane indicated by 5—5 in FIG. 4.
Figure 6:
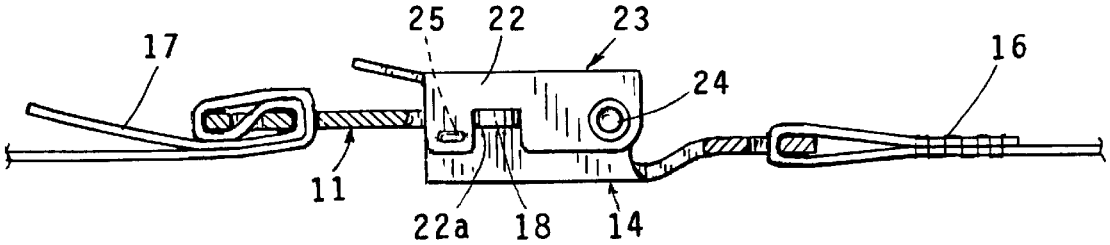
FIG. 6 is a side elevational view of the first embodiment showing the latching member in its locked position.

To provide the second locking action, latch member is rotated to the position shown in FIGS. 4–6. In this latched position, detents 25 on the latch member engage and ride under detents 26 on the end of ledge portion 21 and the ends of the "T" 18 of adjuster member 11 fit into slots 22*a* on the side portions 22 of the latch member. The latch member is thus retained in the latched position. In the latched position the latch member prevents the T-shaped end 18 of the adjuster member from coming out of slot 20 even without there being tension on the strap. It is further to be noted that latch member 23 cannot be brought to its locked position as shown in FIG. 4 unless the T-shaped adjuster end 18 is fully seated in slot 20 providing an added safety factor assuring that both locking actions have been achieved.

Figure 7:
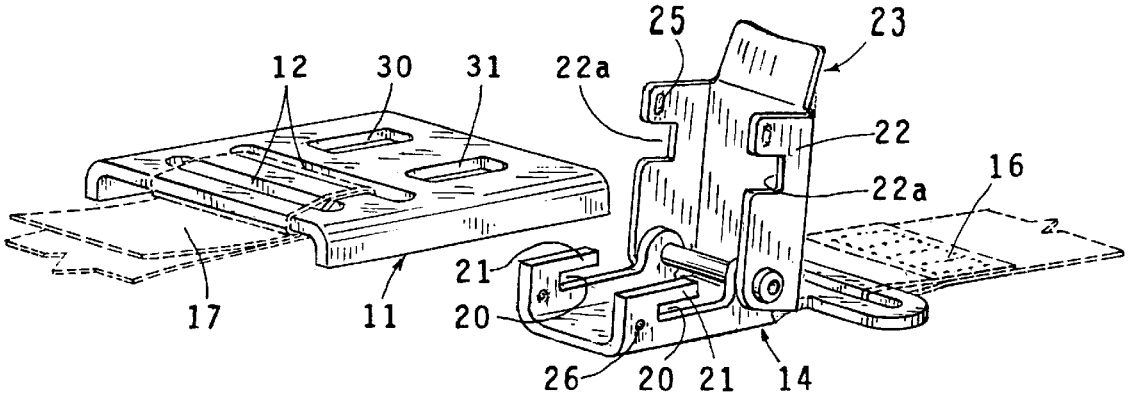
FIG. 7 is a side perspective view showing a second embodiment of the invention prior to the installation of the adjuster member in the frame.
Figure 8:
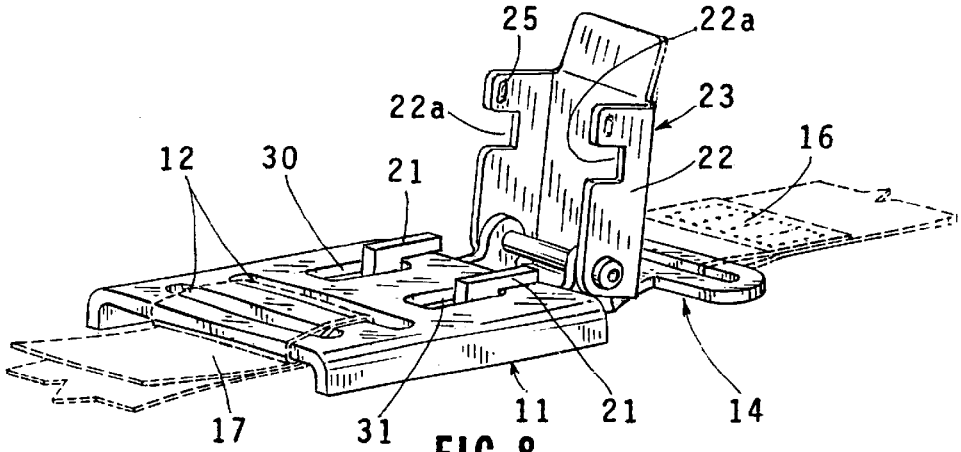
FIG. 8 is a side perspective view of the second embodiment showing the adjuster member installed in the frame with the latching member in the raised position.
Figure 9:
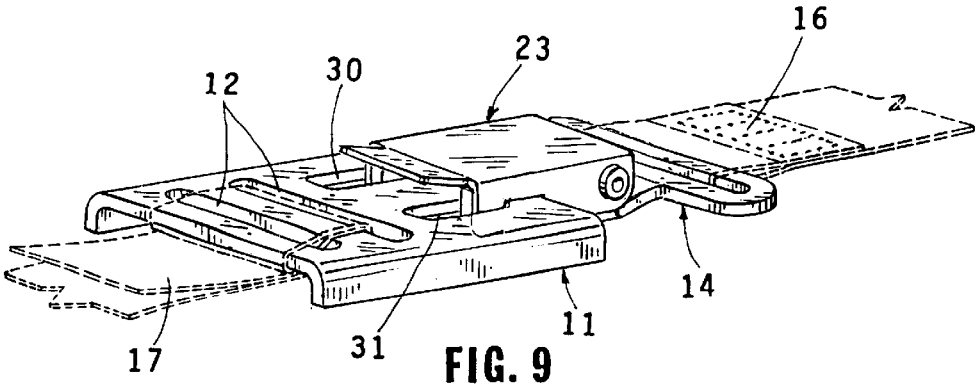
FIG. 9 is a side perspective view of the second embodiment showing the latch member in its locked position.

Referring now to FIGS. 7–9, a second embodiment of the device of the invention is illustrated. In this embodiment, rather than employing a "T" shaped end portion in the adjuster member, a pair of elongated longitudinal slots 30 and 31 are formed in the forward portion of the wall of the adjuster member into which the slotted ledge portions 21 of the frame are fitted to provide the first latching action. To provide the second latching action, latch member 23 is lowered down onto the adjuster member so that one end of its side portions 22 enter the slots 30 and 31 and the ends of the adjuster member fit into slots 22*a*. The remainder of the second embodiment is the same as the first.

Figure 10:
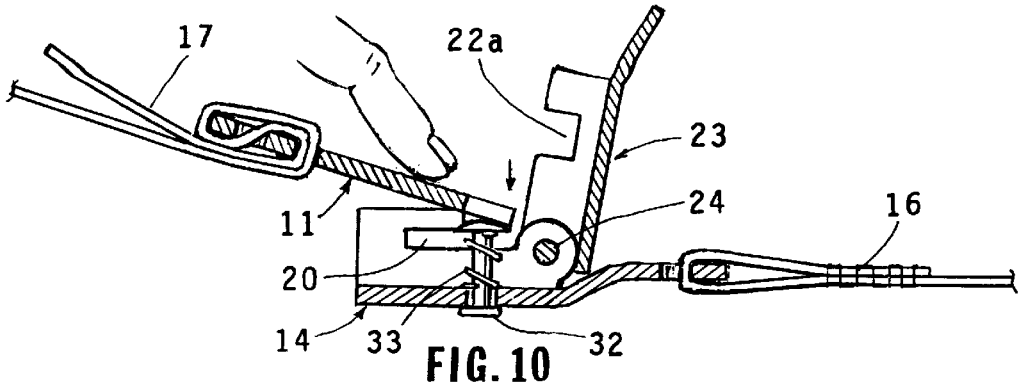
FIG. 10 is a side elevational view showing an additional latching member which may be employed,about to be installed.
Figure 11:
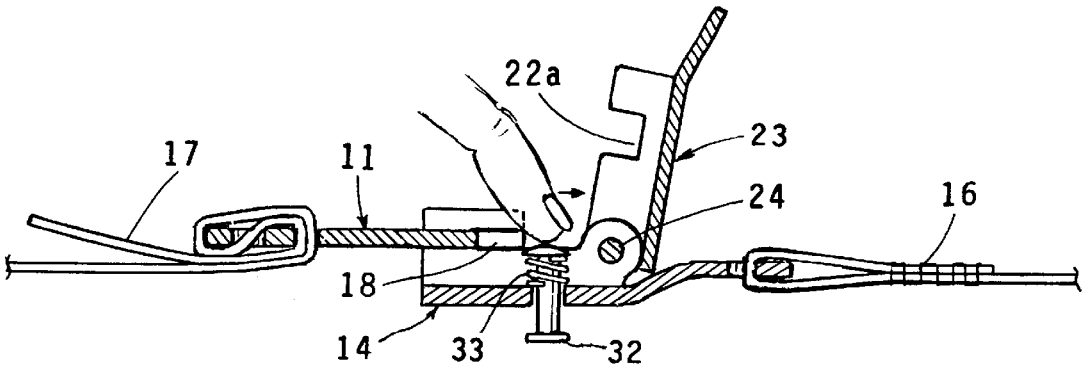
FIG. 11 is a side elevational view of the latching member of FIG. 10 shown in its unlocked position.
Figure 12:
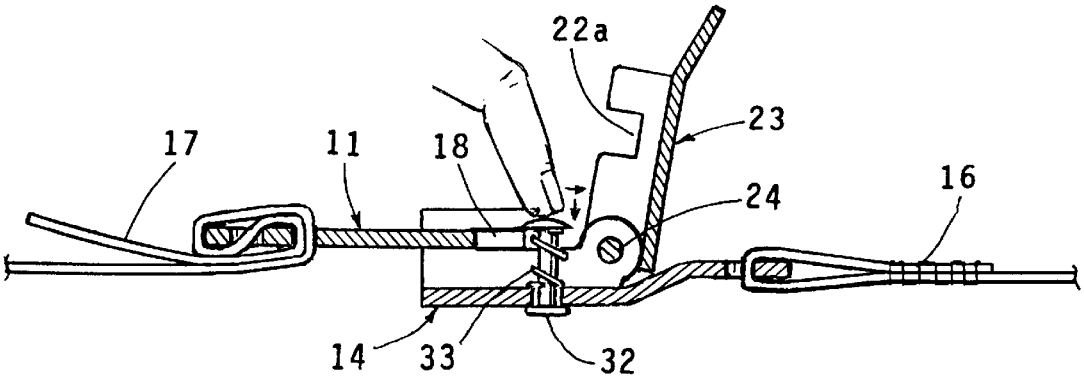
FIG. 12 is a side elevational view of the latching member of FIG. 10 showing it after having been manually released to its locked position.

Referring now to FIGS. 10–12, an additional latching member which may be employed for providing additional latching action with either of the embodiments of the invention is illustrated. Pin member 32 is installed in an aperture in the base of frame member 14 in a position directly opposite the end of adjuster member 11. The top end of the pin member is urged away from the base of the frame member by spring 33. FIG. 10 shows the adjuster member about to be installed in the slots 20 in the sides of base member 14. Pin 32 is depressed against the spring tension, as shown in FIG. 11, thereby permitting the installation of the adjuster member in the slots 20. The pin member is then released, as shown in FIG. 12 and stands in a position to prevent the exit of the ends of the adjuster member from the slot, thus providing an additional latching action.

While the invention has been described in detail, it is to be understand that this is intended by way of illustration and example only, the scope of the invention being limited by the terms of the following claims.

I claim:

1. A double locking buckle for fastening two pieces of webbing or strap together comprising:

a frame, said frame being slotted and having detent means formed thereon, a latch member having detent means formed thereon, means for pivotally supporting said latch member on said frame, an adjuster member having an end portion fitted into the slotted portion of the frame for retention therein when tension is placed on said adjuster member to hold said end portion in said slotted portion, a first strap portion attached to said frame, and a second strap portion adjustably attached to said adjuster member, a first locking action of said buckle being attained with the placement of tension on said second strap portion, a second locking action of said buckle being achieved with said latching member in a downward position against said frame so as to securely retain the end portion of said adjuster member in the slotted portion of said frame, the detent means of said frame engaging the detent means of said latch member to retain said latch member to said frame.

2. The device of claim 1 wherein the detent means of said frame comprises a pair of oppositely positioned detents formed in said frame.

3. The device of claim 1 wherein the end portion of said adjuster member is the top of a T-shaped element.

4. The device of claim 3 wherein the latch member has opposite sides with slots formed therein, the ends of the top of the T-shaped element fitting into said slots to firmly retain the adjuster member to the base member.

5. The device of claim 1 wherein the adjuster member has a pair of elongated slots formed in an end portion thereof, the slotted portion of said frame being fitted into the slots of said adjuster member.

6. The device of claim 1 wherein the means for pivotally supporting said latch member on said frame comprises a shaft fixedly mounted on said frame.

7. The device of claim 1 wherein said adjuster member has transverse slots formed therein said second strap end portion being reeved through said slots so as to permit adjustment of its effective length and the tension therein.

8. A double locking buckle for fastening two pieces of webbing or strap together comprising:

a frame having a pair of opposing ledge portions with detents formed thereon, said ledge portions running opposite the base portion of the frame, a slot being formed between each of the ledge portions and the frame base portion, a shaft mounted transversely on said frame, a latch member having opposite side portions, each of said side portions having a slot and detent formed therein, an adjuster member having a T-shaped end portion, said end portion being fitted into the slotted portions of the frame for retention therein, said adjuster member further having a pair of transverse slots formed in the end thereof opposite to said T-shaped end portion, first and second strap portions, the end of said first strap portion being attached to said frame, and the end of said second strap portion being adjustably reeved through the transverse slots of said adjuster member, there being a first locking action of said buckle with the placement of tension on the end of said second strap portion and a second locking action with said latch member in a downward position against said frame so as to securely retain the end portion of said adjuster member in the slots formed in the frame, the detents of said frame ledge portions engaging the detents of said latch member, and the slots of said latch member engaging the ends of the T-shaped portions of said adjuster member to securely retain said adjuster member in the slots of the frame member.

9. The device of claim 8 and further including a pin member slidably mounted in a hole in the base of the frame, spring means for urging the top end of said pin member upwardly from the frame base, the top end of said pin member being opposite the T-shaped end portion so as to block passage of said T-shaped end portion out of the slotted portion of the frame.

* * * * *